US008651887B2

(12) United States Patent
Zhang

(10) Patent No.: US 8,651,887 B2
(45) Date of Patent: Feb. 18, 2014

(54) COAXIAL CONNECTOR'S PLUG AND SOCKET AS WELL AS COAXIAL CONNECTOR

(71) Applicant: Huawei Technologies Co., Ltd., Guangdong (CN)

(72) Inventor: Yingfeng Zhang, Shenzhen (CN)

(73) Assignee: Huawei Technologies Co, Ltd., Shenzhen (CN)

( * ) Notice: Subject to any disclaimer, the term of this patent is extended or adjusted under 35 U.S.C. 154(b) by 0 days.

(21) Appl. No.: 13/725,012

(22) Filed: Dec. 21, 2012

(65) Prior Publication Data

US 2013/0109210 A1 May 2, 2013

Related U.S. Application Data

(63) Continuation of application No. PCT/CN2011/075001, filed on May 31, 2011.

(30) Foreign Application Priority Data

Jun. 24, 2010 (CN) ..... 2010 1 0213602

(51) Int. Cl.
*H01R 13/62* (2006.01)

(52) U.S. Cl.
USPC ..... 439/352; 439/578

(58) Field of Classification Search
USPC ..... 439/352, 578
See application file for complete search history.

(56) References Cited

U.S. PATENT DOCUMENTS

| | | | | |
|---|---|---|---|---|
| 4,443,052 | A | 4/1984 | Eaby et al. | |
| 5,176,533 | A * | 1/1993 | Sakurai et al. | 439/352 |
| 5,595,499 | A * | 1/1997 | Zander et al. | 439/352 |
| 6,692,286 | B1 | 2/2004 | De Cet | |
| 2007/0123101 | A1 | 5/2007 | Palinkas | |
| 2009/0275226 | A1 | 11/2009 | Chen | |
| 2010/0304598 | A1 * | 12/2010 | Kari | 439/352 |

FOREIGN PATENT DOCUMENTS

| | | | |
|---|---|---|---|
| CN | 1382316 | A | 11/2002 |
| CN | 2870228 | Y | 2/2007 |
| CN | 1979956 | A | 6/2007 |
| CN | 101005180 | A | 7/2007 |
| CN | 201038512 | Y | 3/2008 |
| CN | 201038519 | Y | 3/2008 |
| CN | 101154781 | A | 4/2008 |

(Continued)

OTHER PUBLICATIONS

1st Office Action in corresponding Chinese Patent Application No. 201010213602.7 (Oct. 26, 2011).

(Continued)

*Primary Examiner* — Gary Paumen
(74) *Attorney, Agent, or Firm* — Leydig, Voit & Mayer, Ltd.

(57) ABSTRACT

A coaxial connector's plug and socket as well as a coaxial connector are provided. The coaxial connector's plug comprises: a plug body (10) comprising a centre conductor (11), an insulator (12) provided around the centre conductor and a shell (13) provided around the insulator; a locking member (14) sleeved on the shell and comprising a supporting ring (141) and at least two claws (142) with their roots provided on the supporting ring; an unlocking sleeve (16) provided on the locking member and comprising an unlocking operation portion (161) and windows matching with the claws.

10 Claims, 9 Drawing Sheets

(56) References Cited

FOREIGN PATENT DOCUMENTS

| | | | |
|---|---|---|---|
| CN | 201061042 | Y | 5/2008 |
| CN | 201066748 | Y | 5/2008 |
| CN | 201117937 | Y | 9/2008 |
| CN | 201126906 | Y | 10/2008 |
| CN | 201171086 | Y | 12/2008 |
| CN | 201266724 | Y | 7/2009 |
| CN | 201303131 | Y | 9/2009 |
| CN | 101656380 | A | 2/2010 |
| CN | 101888040 | A | 11/2010 |
| CN | 101888040 | B | 11/2010 |
| GB | 2300768 | A | 11/1996 |

OTHER PUBLICATIONS

International Search Report in corresponding International Patent Application No. PCT/CN2011/075001 (Aug. 11, 2011).

Written Opinion of the International Searching Authority in corresponding International Patent Application No. PCT/CN2011/075001 (Aug. 11, 2011).

* cited by examiner

COAXIAL CONNECTOR'S PLUG AND SOCKET AS WELL AS COAXIAL CONNECTOR

CROSS-REFERENCE TO RELATED APPLICATIONS

This application is a continuation of International Patent Application No. PCT/CN2011/075001, filed on May 31, 2011, which claims priority to Chinese Patent Application No. 201010213602.7, filed on Jun. 24, 2010, both of which are hereby incorporated by reference in their entireties.

FIELD OF THE INVENTION

The present disclosure relates to the field of connector technologies, and more specifically, relates to a coaxial connector's plug and socket as well as a coaxial connector.

DESCRIPTION OF THE RELATED ART

A coaxial connector is a connector in a form of a coaxial structure, comprising a plug and a socket. The plug and the socket are generally composed of three basic parts of a centre conductor, an insulator and a shell.

Coaxial connector has been widely used. For example, in wireless base station devices, radio frequency modules generally use DIN coaxial connectors as signal transmitting and receiving ports of the radio frequency modules and antennas.

In existing technologies, plug and socket of a DIN coaxial connector are screwed together by means of threads. The plug and the socket of the DIN coaxial connector both include a centre conductor and a shell provided around the centre conductor.

The plug and the socket of the DIN coaxial connector are in clearance fit, with the shell diameter of the plug larger than the shell diameter of the socket.

The centre conductor of the plug is a solid column while the centre conductor of the socket is a hollow column for receiving the centre conductor of the plug and has evenly distributed grooves.

The shell of the plug of the DIN coaxial connector has threads provided on its inner side, while the socket of the DIN coaxial connector has threads provided on its outer side, which match with the threads on the plug. When the plug and the socket are securely screwed together by means of the threads, the centre conductor of the plug and the centre conductor of the socket create a plug connection, thereby achieving the mating of the plug and the socket.

During contemplating the present invention, the inventor has found at least the following defects in the existing technologies. Since the plug and the socket are screwed together by means of threads, auxiliary tools such as torque wrenches are required for doing so, which is inconvenient for operation. Moreover, for overhead work under a tower top aerial environment, there are security risks when using wrenches in operation. Furthermore, in an outdoor operation environment, after the plug and the socket are fit, it is necessary to wind with waterproof adhesive tapes with gumming dirt for waterproof processing, which is inconvenient for installation and results in a low efficiency.

SUMMARY

The embodiments of the present disclosure propose a coaxial connector's plug and a socket as well as a coaxial connector, for realizing a quick connection/disconnection between the plug and the socket.

According to an embodiment of the present disclosure, a coaxial connector's plug is provided, comprising: a plug body which comprises a centre conductor, an insulator provided around the centre conductor and a shell provided around the insulator; a locking member sleeved on the shell and comprising a supporting ring and at least two claws with their roots provided on the supporting ring; an unlocking sleeve provided on the locking member and comprising an unlocking operation portion and windows matching with the claws.

According to another embodiment of the present disclosure, a coaxial connector's socket is provided, comprising: a centre conductor, an insulator provided around the centre conductor, and a shell provided around the insulator; wherein a portion of the shell for connecting a plug is an annular groove, and a groove matching with claws of the plug is provided on an inner side of an outer wall of the annular groove.

According to yet another embodiment of the present disclosure, a coaxial connector is provided, comprising the coaxial connector's plug and the coaxial connector's socket as described above.

In the technical solution provided by the above embodiments, by providing a locking member having at least two claws and an unlocking sleeve in a plug, and correspondingly providing a groove on the inner side of a shell of a socket matching with the claws, the plug can be quickly inserted into the socket of a coaxial connector, thereby realizing a quick connection/disconnection between the plug and the socket as well as simplifying the connecting operation for the coaxial connector.

BRIEF DESCRIPTION OF THE DRAWINGS

In order to more clearly describe the technical solution in the embodiments of the present disclosure, the accompanying drawings that need to be used in the embodiments will be briefly introduced. Apparently, these accompanying drawings are merely some embodiments of the present invention, and for one of ordinary skill in the art, other drawings can be obtained based on these accompanying drawings without paying any creative effort.

DESCRIPTION OF THE EMBODIMENTS

Below, the technical solutions in the embodiments of the present disclosure will be clearly and completely described in conjunction with the drawings in the embodiments of the present disclosure. Apparently, the described embodiments are merely some embodiments of the present invention instead of all possible embodiments. Based on the embodiments of the present disclosure, one of ordinary skill in the art can obtain other embodiments without paying any creative efforts, which all fall within the scope of the present invention.

Figure 1:
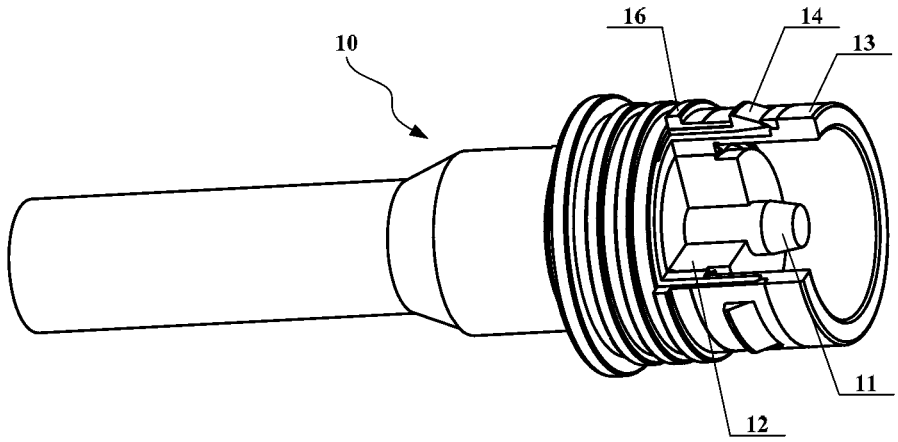
FIG. 1 is a structural diagram of a coaxial connector's plug according to an embodiment of the present invention.

FIG. 1 is a structural diagram of a coaxial connector's plug according to an embodiment of the present invention. In order to clearly show the inner structure of the plug, some portions of the plug are omitted in FIG. 1.

As shown in FIG. 1, the coaxial connector's plug comprises a plug body 10, a locking member 14 and an unlocking sleeve 16.

The plug body comprises a centre conductor 11, an insulator provided around the centre conductor 11, and a shell 13 provided around the insulator 12.

The locking member 14 is sleeved on the shell 13.

Figure 2:
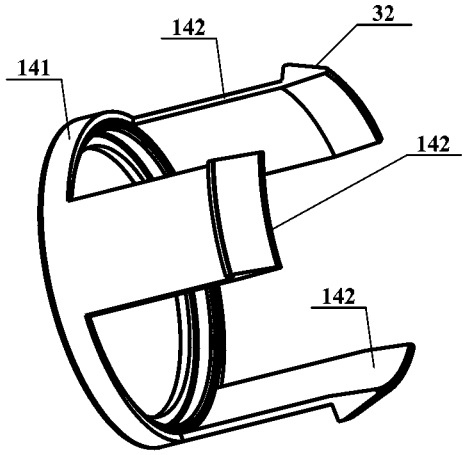
FIG. 2 is a structural diagram of a locking member of the coaxial connector's plug according to an embodiment of the present invention.

As shown in FIG. 2, the locking member 14 comprises a supporting ring 141 and at least two claws 142, wherein the claws 142 have their roots provided on the supporting ring 141, and the claws 142 have a cantilever barb structure. When barbs are locked, barb slants 32 are located in a groove of the socket, while during unlocking, the claws 142 are contracted using the barb slants, thereby achieving the unlocking.

Figure 3:
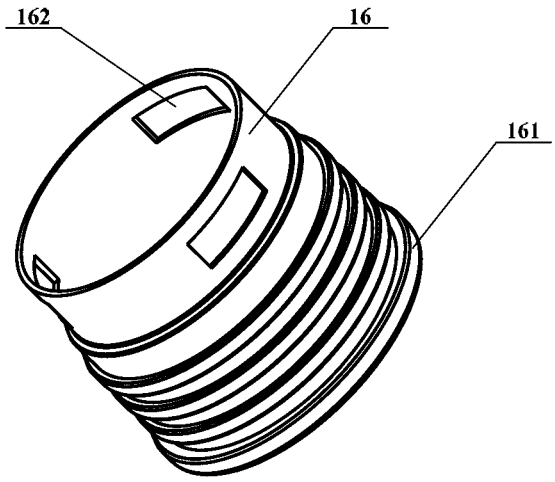
FIG. 3 is a structural diagram of an unlocking sleeve of the coaxial connector's plug according to an embodiment of the present invention.

As shown in FIG. 3, the unlocking sleeve 16 has an unlocking operation portion 161 and windows 162 matching with the claws 142.

Figure 4:
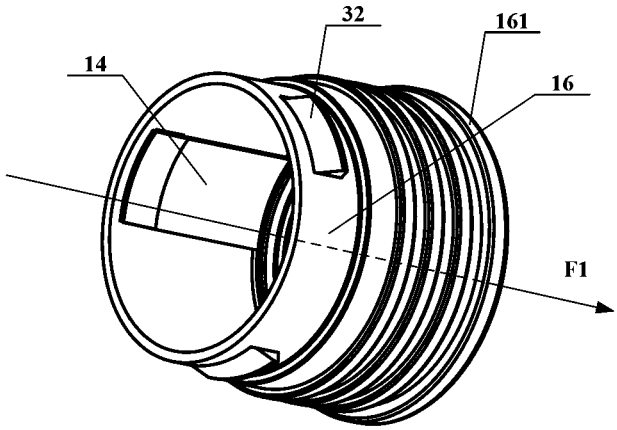
FIG. 4 is a structural diagram where the locking member and the unlocking sleeve of the coaxial connector's plug are fitted together according to an embodiment of the present invention.

As shown in FIG. 4, when the unlocking sleeve 16 is sleeved on the locking member 14, the barbs on the claws 142 of the locking member 14 protrude from the windows 162 so as to achieve the locking with the socket via the protruding portions of the barbs, and the top edge of each window 162 is against the barb slant 32 of the corresponding claw 142. During unlocking, the unlocking operation portion 161 is operated to apply a force in a direction indicated by the arrow F1 and hence apply a force on the barb slants 32 of the claws 142 via the top edges of the windows 162, such that the claws are automatically contracted to achieve the unlocking.

Figure 5:
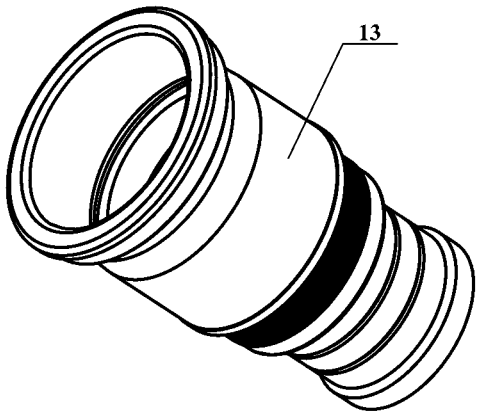
FIG. 5 is a structural diagram of a shell of the coaxial connector's plug according to an embodiment of the present invention.

The structural diagram of the shell 13 is specifically shown in FIG. 5, which is a cylinder with its inner portion being used for accommodating the centre conductor 11 and the insulator 12.

Figure 6:
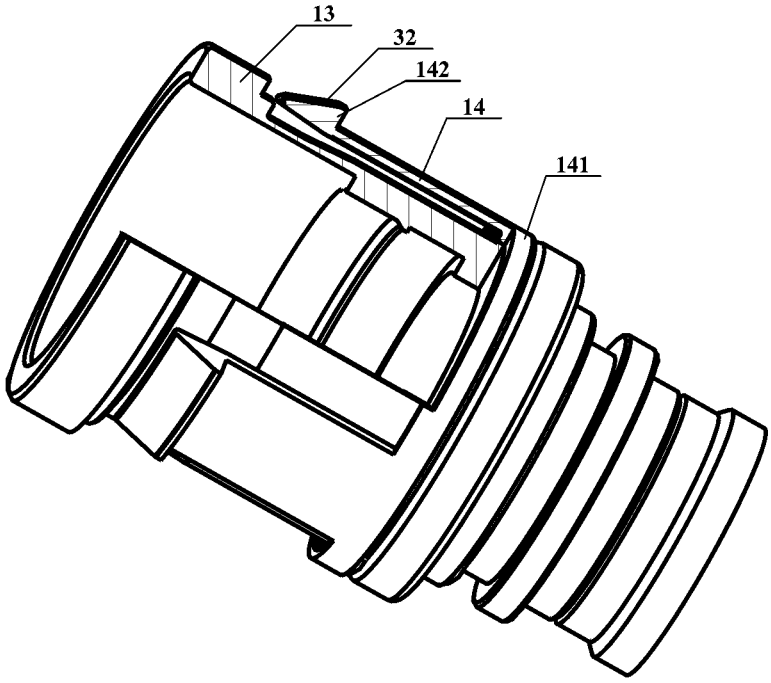
FIG. 6 is a structural diagram where the body portion and the locking member of the coaxial connector's plug are fitted together according to an embodiment of the present invention.

As shown in FIG. 6, the locking member 14 is sleeved on the shell 13. In order to clearly show the fit structure between the locking member 14 and the shell 13, some portions of the locking member and the shell are omitted.

Figure 7:
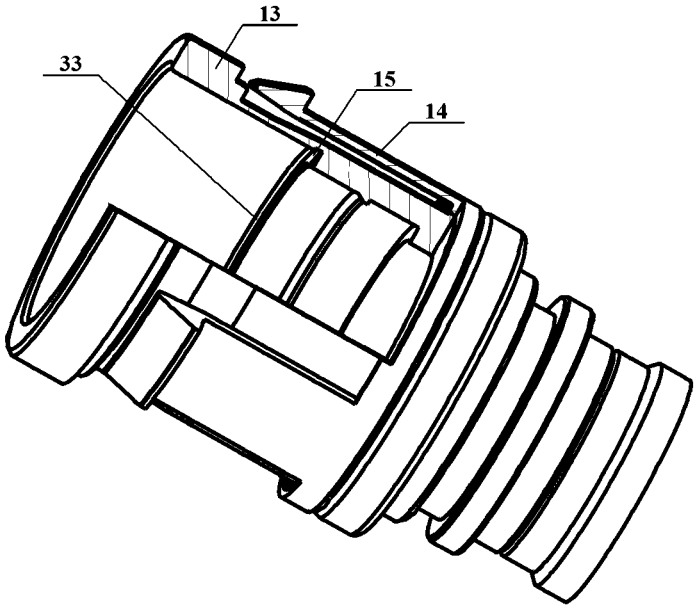
FIG. 7 is a structural diagram where the elastic ring, the shell and the locking member of the coaxial connector's plug are fitted together according to an embodiment of the present invention.

As shown in FIG. 7, an elastic ring 15, the shell 13 and the locking member 14 are nested in turn, with the elastic ring 15 being located innermost and the locking member 14 being located outermost. In FIG. 7, some portions of the shell, the locking member and the elastic ring are omitted, to more clearly show the structural diagram when these three components are fitted together. When the plug is mated with the socket, the upper surface 33 of the elastic ring 15 tightly contacts with the top surface of the inner wall of the annular groove of the socket, ensuring the reliability of electrical conduction.

Figure 8:
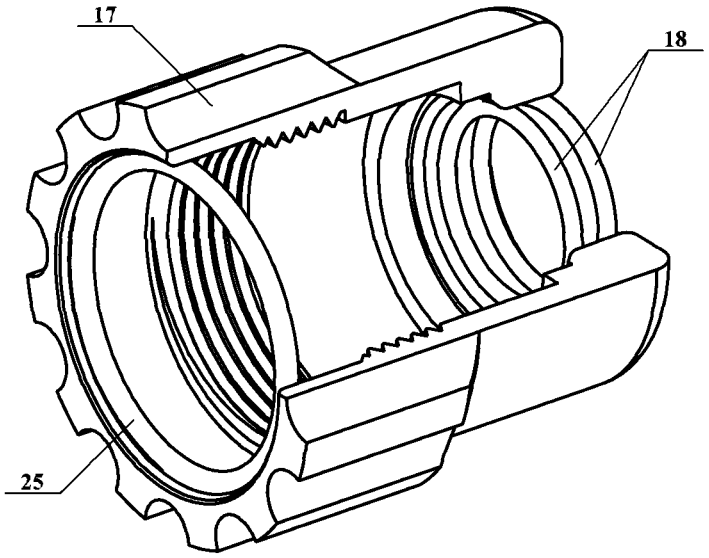
FIG. 8 is a structural diagram of a waterproof case for the coaxial connector's plug according to an embodiment of the present invention.

The coaxial connector's plug according to an embodiment of the present invention can further comprise a waterproof case 17, a second sealing ring 25 and tail sealing rings 18 as shown in FIG. 8. The second sealing ring 25 is used for enabling the seal between the waterproof case 17 and the socket, and the tail sealing rings 18 are used for enabling the seal between the waterproof case 17 and the plug. In FIG. 8, some portions of the waterproof case are omitted, so as to show the inner structure of the waterproof case.

There are threads provided on the inner wall of the head of the waterproof case 17 for engaging with the threads on the socket.

Figure 9:
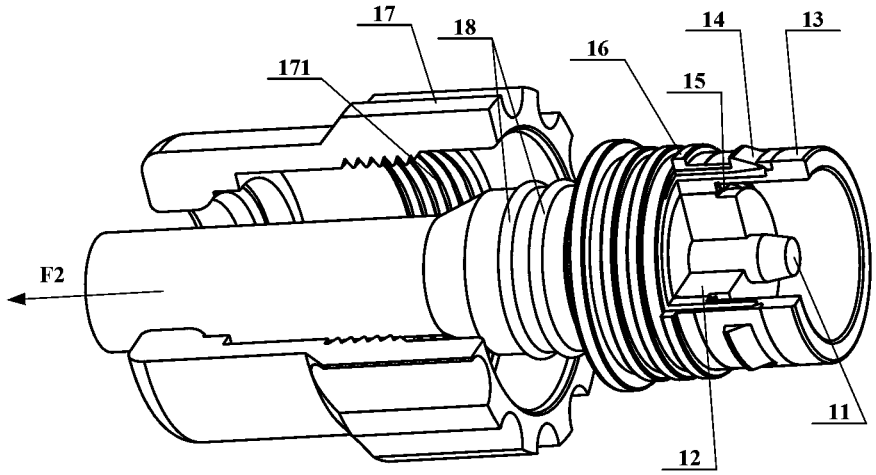
FIG. 9 is a structural diagram before the waterproof case is screwed on the coaxial connector's plug according to an embodiment of the present invention.

Before screwing the waterproof case 17, as shown in FIG. 9, the plug passes through the waterproof case 17 in the direction indicated by the arrow F2. During the screwing, the plug firstly couples with the socket, and then the waterproof case 17 is screwed using the threads on the socket and the threads 171 on the waterproof case.

The waterproof case is not limited to being screwed by means of threads, so long as it is able to achieve a sealed joint between the waterproof case and the socket.

In FIG. 9, some portions of the waterproof case, the unlocking sleeve, the locking member, the shell and the insulator are omitted, so as to more clearly show the inner structure of the plug.

Figure 10:
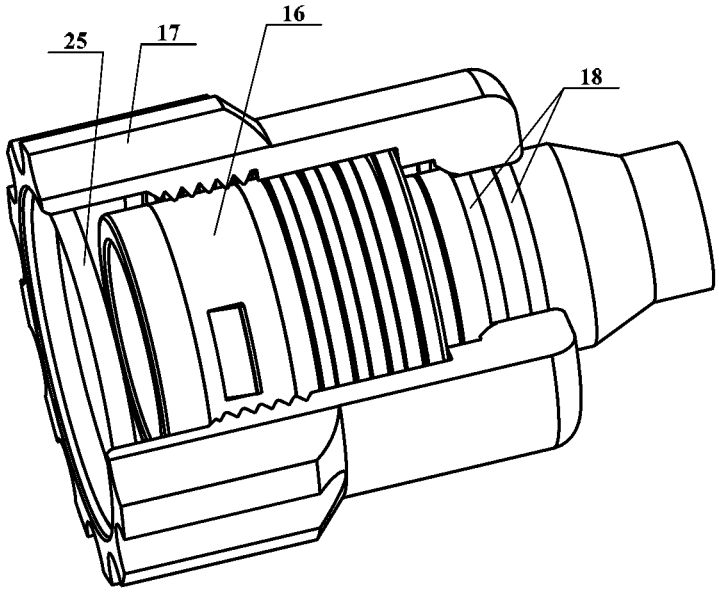
FIG. 10 is a structural diagram after the waterproof case is screwed on the coaxial connector's plug according to an embodiment of the present invention.

The structural diagram after the waterproof case 17 is screwed on the plug is shown in FIG. 10. The inside diameter of the portion of the waterproof case 17 that is provided with threads (i.e., the head) matches with the outside diameter of the unlocking sleeve 16. The second sealing ring 25 matches with the inside diameter of the head of the waterproof case 17, and the tail sealing rings 18 are provided at the tail of the plug and matches with the inside diameter of the tail of the waterproof case 17.

In FIG. 10, some portions of the waterproof case are omitted, so as to more clearly show the structure of the plug inside the waterproof case.

Figure 11:
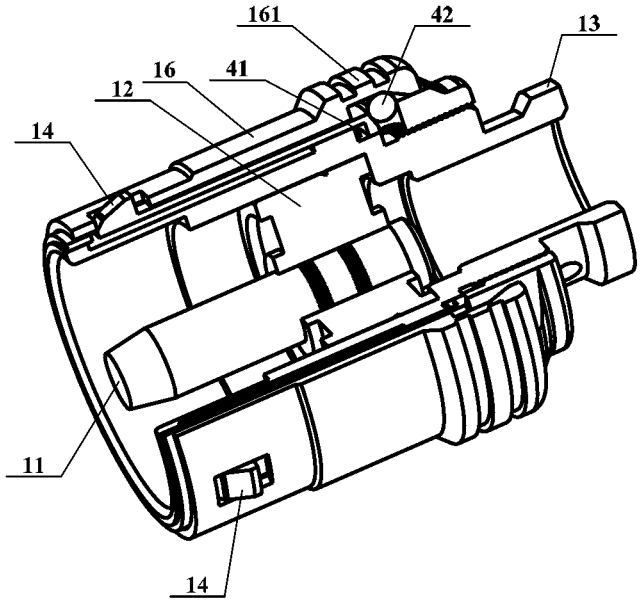
FIG. 11 is a diagram of clearance fit of the unlocking sleeve and the locking member of the coaxial connector's plug with ball bearings provided between the unlocking sleeve and the locking member according to an embodiment of the present invention.
Figure 12:
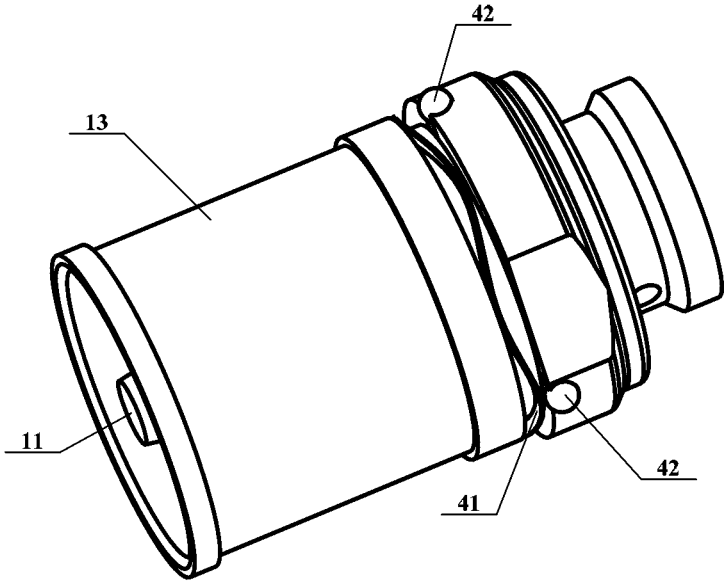
FIG. 12 is a diagram of a floating mechanism in the unlocking sleeve of the coaxial connector's plug according to an embodiment of the present invention.

The unlocking sleeve 16 and the locking member 14 are in clearance fit and can freely float. Specifically, as shown in FIG. 11, ball bearings 42 can be provided between the unlocking operation portion 161 of the unlocking sleeve 16 and the shell 13, and an elastic washer 41 can be provided between the supporting ring 141 of the locking member 14 and the shell 13, thereby enabling the floating between the unlocking sleeve 16 and the locking member 14. As shown in FIG. 12, the elastic washer 41 is an annular elastic ring having a wave-like shape. After the unlocking sleeve 16 is sleeved on the locking member 14, the elastic washer 41 is located inside the supporting ring 141 of the locking member 14, providing an elastic bearing function for the supporting ring 141. The ball bearings 42 are located between the unlocking operation portion 161 and the shell 13, such that the unlocking operation portion 161 floats around the shell 13. When a force is applied on the unlocking operation portion 161, the ball bearings 42 roll consequently, and enabling reduction of the friction between the unlocking operation portion 161 and the shell 13.

The floating manner between the unlocking sleeve 16 and the locking member 14 is not limited to the above manner such as the wave-like washer in combination with ball bearings, so long as the unlocking operation portion 161 can be movable with respect to the locking member 14.

In FIG. 11, some portions of the unlocking sleeve, the locking member, the shell and the insulator are omitted, so as to more clearly show the inner structure of the plug.

Figure 13:
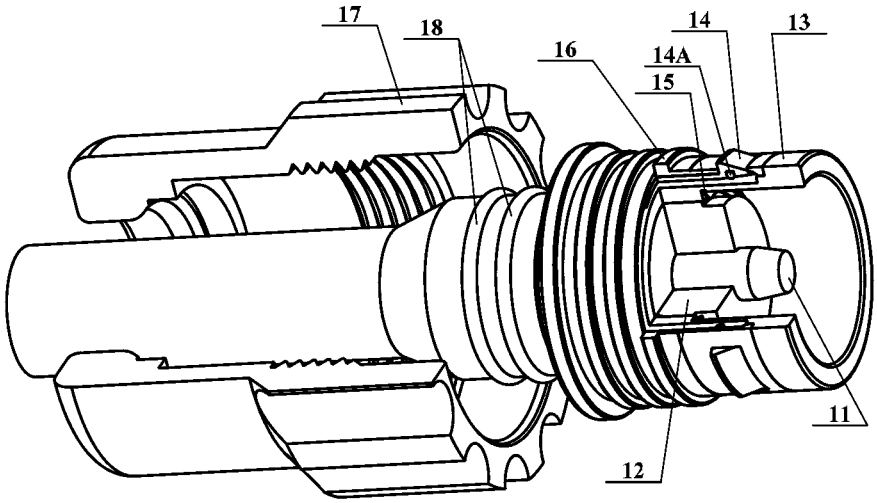
FIG. 13 is a structural diagram of another kind of coaxial connector's plug according to an embodiment of the present invention.
Figure 14:
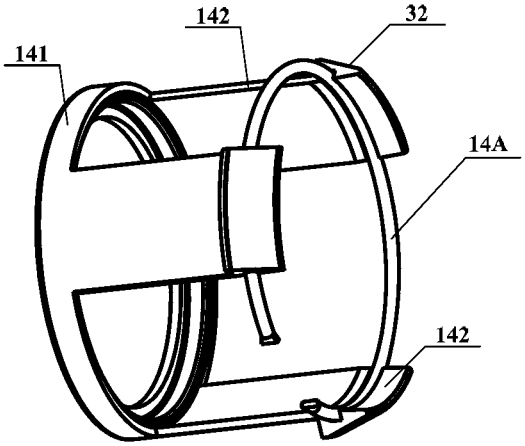
FIG. 14 is a structural diagram of another kind of locking member in a coaxial connector's plug according to an embodiment of the present invention.

As shown in FIG. 13, an elastic bearing member 14A is provided on the inner side of the claws 142 of the locking member 14. As shown in FIG. 14, the elastic bearing member 14A is an elastic ring with a gap. By both of providing an elastic bearing member on the inner side of the barbs of the claws 142 and providing an elastic bearing member in the plug, the elastic functionality of the claws 142 of the locking member 14 can be enhanced, such that the locking member can be repeatedly locked and unlocked, which satisfies the requirement for connecting and disconnecting the coaxial connector for many times.

The inner side of the claws 142 is not limited to the use of the elastic bearing member 14A, so long as it can provide an elastic bearing function for the claws 142.

In FIG. 13, some portions of the waterproof case, the unlocking sleeve, the locking member, the shell and the insulator are omitted, so as to more clearly show the inner structure of the plug.

The claws 142 are supported by the elastic bearing member 14A, ensuring the claws 142 to be elastic and reliable.

Figure 15:
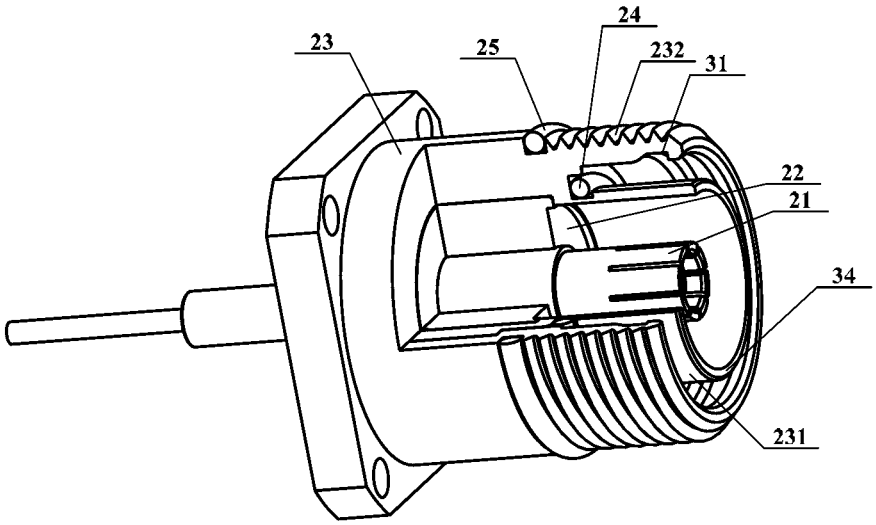
FIG. 15 is a structural diagram of a coaxial connector's socket according to an embodiment of the present invention.

As shown in FIG. 15, the coaxial connector's socket comprises a centre conductor 21, an insulator provided around the centre conductor 21, and a shell 23 provided around the insulator 22.

In FIG. 15, some portions of the shell 23, the insulator 22, the first sealing ring 24 and the second sealing ring 25 are omitted, so as to more clearly show the inner structure of the socket.

The portion of the shell 23 for connecting the plug is an annular groove, which comprises an inner wall 231 and an outer wall 232.

A groove 31 matching with the barbs of the claws 142 of the plug is provided on the inner side of the outer wall 232 of the annular groove to enable the locking functionality.

The annular groove can have a first sealing ring 24 provided on its bottom.

Threads matching with the threads on the inner wall of the waterproof case 17 are provided on the outer surface of the shell 23 (i.e., on the outer side of the outer wall 232).

The second sealing ring 25 matching with the inside diameter of the waterproof case 17 can be provided at the thread relief on the shell 23. That is, the second sealing ring 25 can either be a portion of the coaxial connector's plug or be a portion of the coaxial connector's socket.

The socket portion is optimized on the basis of a standard DIN coaxial connector's socket. In particular, a groove 31 is added on the inner side of the outer wall of the annular groove of the socket, which matches with the barb slants 32 of the claws 142, and in the meanwhile, a first sealing ring 24 is placed within the annular groove, and a second sealing ring 25 is added at the outside thread relief. The optimization of the socket enables quick plug and self-locking functionality while maintaining the features of the standard DIN coaxial connector's socket, thereby achieving an upward compatibility.

The coaxial connector according to an embodiment of the present invention comprises a plug and a socket, in which a quick attachment and detachment between the plug and the socket can be realized. The plug can be any kind of plugs of the coaxial connectors according to the above embodiments, and the socket can be any kind of sockets of the coaxial connectors according to the above embodiments.

Figure 16A:
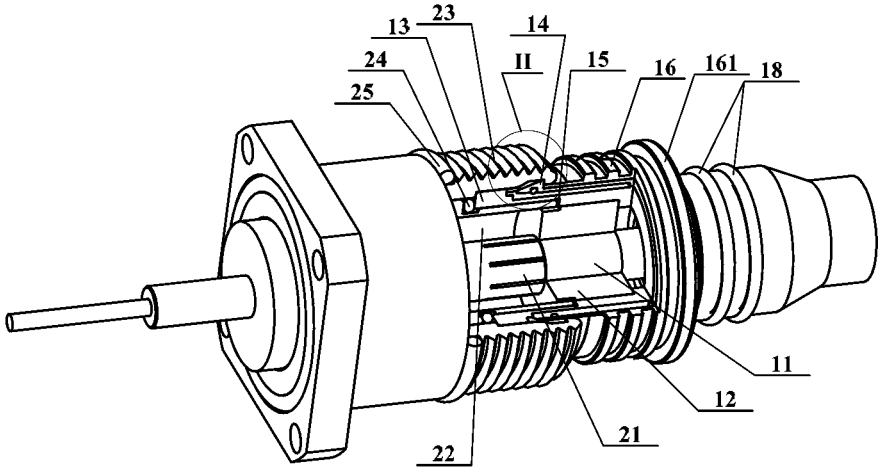
FIG. 16A is a structural diagram of a coaxial connector according to an embodiment of the present invention.
Figure 16B:
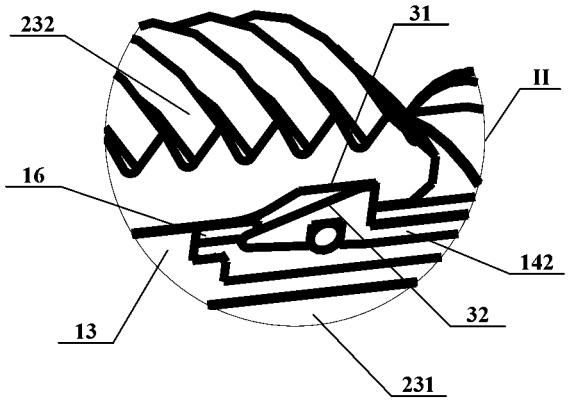
FIG. 16B is an enlarged diagram of portion II of FIG. 16A, i.e., in the case where the locking member is locked.

As shown in FIG. 16A, when the plug is inserted into the socket, a sound "chick" is produced such that an operator can determine whether or not the connection is in place. The upper surface 33 of the elastic ring 15 in the plug completely contacts with the top surface 34 of the inner wall 231 of the annular groove in the socket, effectively ensuring the reliability of electrical conduction when the cable is swaying. Moreover, as shown in FIG. 16B, the barbs of the claws 142 protrude into the groove 31, the cantilevers of the claws 142 is under a force, and thus a mechanical locking between the plug and the socket is achieved.

In FIG. 16A, some portions of the unlocking sleeve, the locking member, the shell and the insulator are omitted, so as to more clearly show the fit structure between the plug and the socket.

During the unlocking, the unlocking operation portion 161 is grabbed by hand and the unlocking sleeve 16 is pulled backwards, such that the top edges of the windows 162 generate a downward force on the barb slants 32 of the claws 142. A horizontal component of the downward force causes the claws 142 to contract towards the centre of the plug, and thus the barbs of the claws 142 exit the groove 31. At this point, the socket is pulled to separate the plug and the socket.

Figure 17:
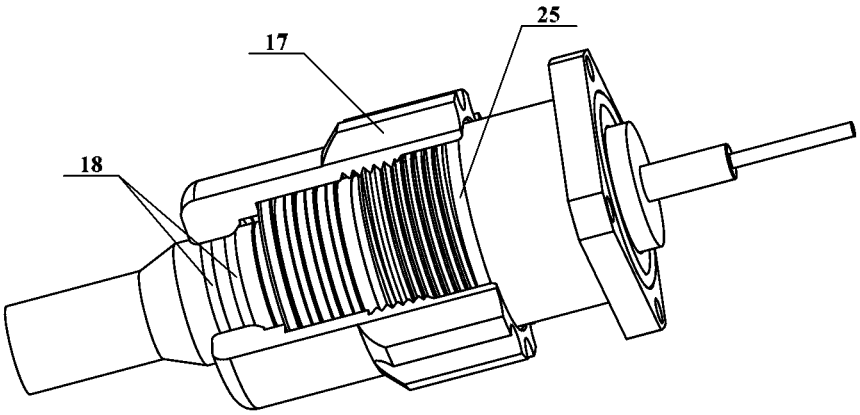
FIG. 17 is a structural diagram of another kind of coaxial connector according to an embodiment of the present invention.

As shown in FIG. 17, the coaxial connector may further comprise a waterproof case 17. The waterproof case 17 can be formed separately from the socket, or can be integrally formed with the plug.

In FIG. 17, some portions of the waterproof case are omitted, so as to more clearly show the inner structure of the coaxial connector.

The plug-and-socket fit itself has an IP68 waterproof effect, and the purpose of adding the waterproof case 17 on the plug is to achieve an even better waterproof effect for an outdoor antenna feeder system. After the plug and the socket are connected, the waterproof case 17 is screwed tightly by hand, and then the entire coaxial connector system reaches the best waterproof state.

The waterproof case has standard threads and is provided internally with a sealing ring. Specifically, the waterproof case 17 can have the tail sealing rings 18 and the second sealing ring 25 and can keep a tight connection with the plug and the socket in a thread-connection manner, which ensures the highly reliable application of the plug and the socket even in a rigorous environment.

After the plug-and-socket fit, the first sealing ring 24 provided within the socket is compressed, serving a waterproof function. When the waterproof case is screwed tightly by hand, the second sealing ring 25 on the socket is also compressed, and in the meanwhile, the tail sealing rings 18 provided within the waterproof case is compressed. In this way, the coaxial connector as a whole has a double waterproof function and can also be protected from dust and salt mist; moreover, the sway of the plug and the socket with each other after the two are mated can be eliminated, enhancing the reliability for outdoor application of the coaxial connector.

The tail sealing rings 18 are not limited to two rings or other waterproof forms. The waterproof case 17 can be formed integrally with the plug. The whole process of operating the plug and the socket are realized by screwing, and the process of screwing the waterproof case will automatically make the plug and the socket mated with each other.

The plug, the socket and the coaxial connector according to the above embodiments provide improvements on the traditional thread installation manner, effectively enhance installation efficiency, reduce operation time, save man power and require no operation tools. Meanwhile, it lowers the requirement for workers' manipulative skills, realizes waterproof protection of the traditional antenna feeder interface without the need of gumming dirt and adhesive tape, and ensures reliable long-term operation of the antenna feeder interface.

The coaxial connector according to the above embodiments is not limited to antenna feeder coaxial connector, but can be any kind of coaxial connectors. The number of the claws in the locking member of the plug is not limited. The built-in elastic bearing member is not limited to an elastic ring but can be implemented in other forms. The connection between the waterproof case and the plug/socket is not limited to a thread connection manner. The floating manner of the unlocking sleeve is not limited to the manner of using a wave-like washer and ball bearings.

Finally, it should be noted that, the above embodiments are merely used for illustrating the technical solutions of the present invention, but are not intended to limit the present invention. Although the present invention has been described in detail with reference to the above embodiments, one of ordinary skill in the art should understand that, the technical solutions recited in the above described embodiments can be modified, or some of the technical features therein can be equivalently replaced. Moreover, these modifications or replacements will not cause the corresponding technical solutions to depart from the spirit and scope of the technical solutions of the various embodiments of the present invention.

What is claimed is:

1. A coaxial connector plug, comprising:

a plug body, the plug body comprising a center conductor, an insulator around the center conductor, and a shell around the insulator;

a locking member around the shell, the locking member comprising a supporting ring and two or more claws, the claws having roots on the supporting ring;

an unlocking sleeve on the locking member, the unlocking sleeve comprising an unlocking operation portion and windows, the windows matching with the claws.

2. The coaxial connector's plug of claim 1, wherein the claws have a cantilever barb structure.

3. The coaxial connector's plug of claim 1, further comprising;

one or more ball bearings located between the unlocking operation portion of the unlocking sleeve and the shell; and an elastic washer located between the supporting ring of the locking member and the shell.

4. The coaxial connector's plug of claim 1, further comprising an elastic bearing member located on the inner side of the claws.

5. The coaxial connector's plug of claim 1, further comprising a waterproof case, wherein the waterproof case has threads provided internally.

6. The coaxial connector's plug of claim 5, further comprising one or more tail sealing rings located at the tail of the plug and matching the inside diameter of the tail of the waterproof case.

7. A coaxial connector's socket, comprising:

a center conductor;

an insulator located around the center conductor; and a shell located around the insulator;

wherein the shell comprises an annular groove for connecting a plug, wherein an inner side of an outer wall of the annular groove comprises a groove for receiving claws of the plug.

8. The coaxial connector's socket of claim 7, further comprising a first sealing ring located on a bottom of the annular groove.

9. The coaxial connector's socket of claim 7, further comprising a second sealing ring with outer diameter that matches an inner diameter of a waterproof case, wherein threads are provided on an outer surface of the shell that match with threads on an inner wall of the waterproof case.

10. A coaxial connector, comprising:

a coaxial connector plug comprising a plug body, the plug body comprising a center conductor, an insulator around the center conductor, and a shell around the insulator, a locking member around the shell, the locking member com rising a supporting ring and two or more claws, wherein the claws have roots on the supporting ring; and an unlocking sleeve on the locking member, the unlocking sleeve comprising an unlocking operation portion and windows, wherein the windows match with the claws; and a coaxial connector socket comprising a center conductor, an insulator located around the center conductor, and a shell located around the insulator wherein the shell comprises an annular groove for connecting a plug and wherein an inner side of an outer wall of the annular groove comprises a groove for receiving claws of the plug.

* * * * *